US010871340B2

(12) United States Patent
Fellows

(10) Patent No.: US 10,871,340 B2
(45) Date of Patent: Dec. 22, 2020

(54) FIRE CONTROL GROUP

(71) Applicant: Franklin Armory Holdings, Inc., Minden, NV (US)

(72) Inventor: Ryan Paul Fellows, Hollister, CA (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

(21) Appl. No.: 16/655,145

(22) Filed: Oct. 16, 2019

(65) Prior Publication Data

US 2020/0124369 A1 Apr. 23, 2020

Related U.S. Application Data

(60) Provisional application No. 62/746,879, filed on Oct. 17, 2018.

(51) Int. Cl.

| | |
|---|---|
| ***F41A 19/15*** | (2006.01) |
| ***F41A 19/16*** | (2006.01) |
| ***F41A 19/43*** | (2006.01) |

(52) U.S. Cl.

CPC ..... *F41A 19/15* (2013.01); *F41A 19/16* (2013.01); *F41A 19/43* (2013.01)

(58) Field of Classification Search

CPC ..... F41A 19/17; F41A 19/15; F41A 19/16

USPC ..... 42/69.01, 69.03

See application file for complete search history.

(56) References Cited

U.S. PATENT DOCUMENTS

2017/0030671 A1* 2/2017 Blake ..... F41A 19/14
2017/0138689 A1 5/2017 Biegel

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

A fire control group has a receiver having opposed sidewalls defining a space configured to receive a fire control group, the opposed sidewalls each defining a pivot pin aperture, the pivot pin apertures being registered with each other, a fire control group including a trigger received in the space, the fire control group defining a transverse pivot pin passage configured to be registered with the pivot pin apertures of the receiver, the fire control group including a pivoting operational element, the fire control group including a pivot pin supporting the pivoting operational element and received in the transverse pivot pin passage and the pivot pin apertures, the firearm having a hand grip aft of the trigger and defining a screw aperture, and a grip screw engaging the hand grip and engaging the fire control group. The grip screw may occupy a medial plane of the firearm.

40 Claims, 7 Drawing Sheets

FIRE CONTROL GROUP

CROSS-REFERENCE TO RELATED APPLICATION

This application claims the benefit of U.S. Provisional Patent Application No. 62/746,879 filed on Oct. 17, 2018, entitled "BFSIII™ for AK," which is hereby incorporated by reference in its entirety for all that is taught and disclosed therein.

FIELD OF THE INVENTION

The present invention relates to firearms and, more particularly, to a fire control group compatible with firearm systems having widely varying tolerances.

BACKGROUND OF THE INVENTION

There are many ways to secure a fire control group, or a cartridge fire control group, to a firearm. The AR-15, AK-47, and many other modern firearms generally connect the fire control group to the firearm via a hammer pin, a trigger pin, and a safety selector shaft. While the AR-15 traditionally is manufactured to rather consistent and relatively tight tolerances, the AK-47 has historically been manufactured in many different countries that do not follow consistent specifications and tolerances. In fact, the AK-47 is a design that commonly credits its reliability to the lack of tight tolerances. Consequently, it is rather difficult to manufacture a tight tolerance fire control group that will work in most AK-47s that have been manufactured and distributed through commercial and other channels across the world. Consequently, even though the tolerances of the AK-47 platform vary wildly, a need exists for a tight tolerance trigger system that will safely function in the variety of AK-47 type firearms currently found in the marketplace. In the context of the specification, the term "AK-47" is used broadly to refer to numerous rifles produced on the Kalashnikov platform, including the SKS, AK-74, and others.

Therefore, a need exists for a new and improved fire control group that is compatible with firearm systems having widely varying tolerances. In this regard, the various embodiments of the present invention substantially fulfill at least some of these needs. In this respect, the fire control group according to the present invention substantially departs from the conventional concepts and designs of the prior art, and in doing so provides an apparatus primarily developed for the purpose of providing a fire control group that is compatible with firearm systems having widely varying tolerances.

SUMMARY OF THE INVENTION

The present invention provides an improved fire control group, and overcomes the above-mentioned disadvantages and drawbacks of the prior art. As such, the general purpose of the present invention, which will be described subsequently in greater detail, is to provide an improved fire control group that has all the advantages of the prior art mentioned above.

To attain this, the preferred embodiment of the present invention essentially comprises a receiver having opposed sidewalls defining a space configured to receive a fire control group, the opposed sidewalls each defining a pivot pin aperture, the pivot pin apertures being registered with each other, a fire control group including a trigger received in the space, the fire control group defining a transverse pivot pin passage configured to be registered with the pivot pin apertures of the receiver, the fire control group including a pivoting operational element, the fire control group including a pivot pin supporting the pivoting operational element and received in the pivot pin passage and the pivot pin apertures, the firearm having a hand grip aft of the trigger and defining a screw aperture, and a grip screw engaging the hand grip and engaging the fire control group. The grip screw may occupy a medial plane of the firearm. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

DESCRIPTION OF THE CURRENT EMBODIMENT

Figure 1:
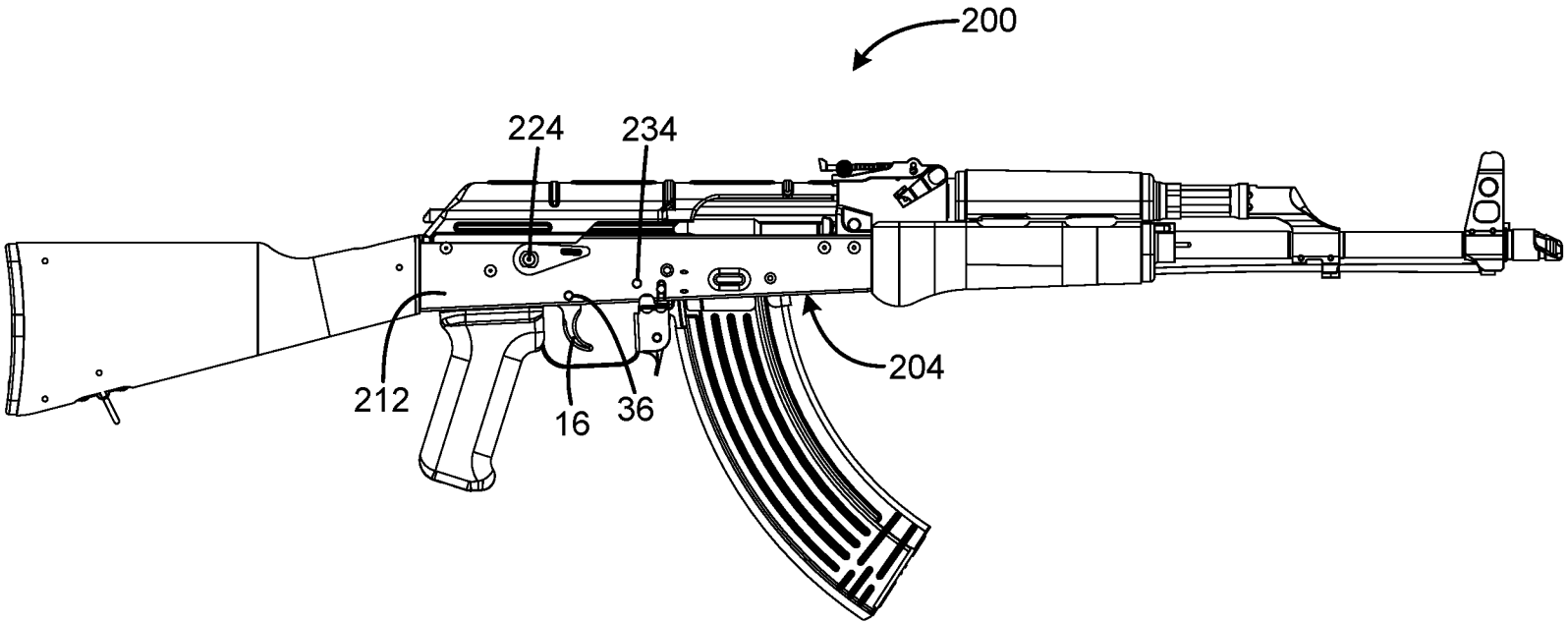
FIG. 1 is a side view of an AK-47 rifle.
Figure 2:
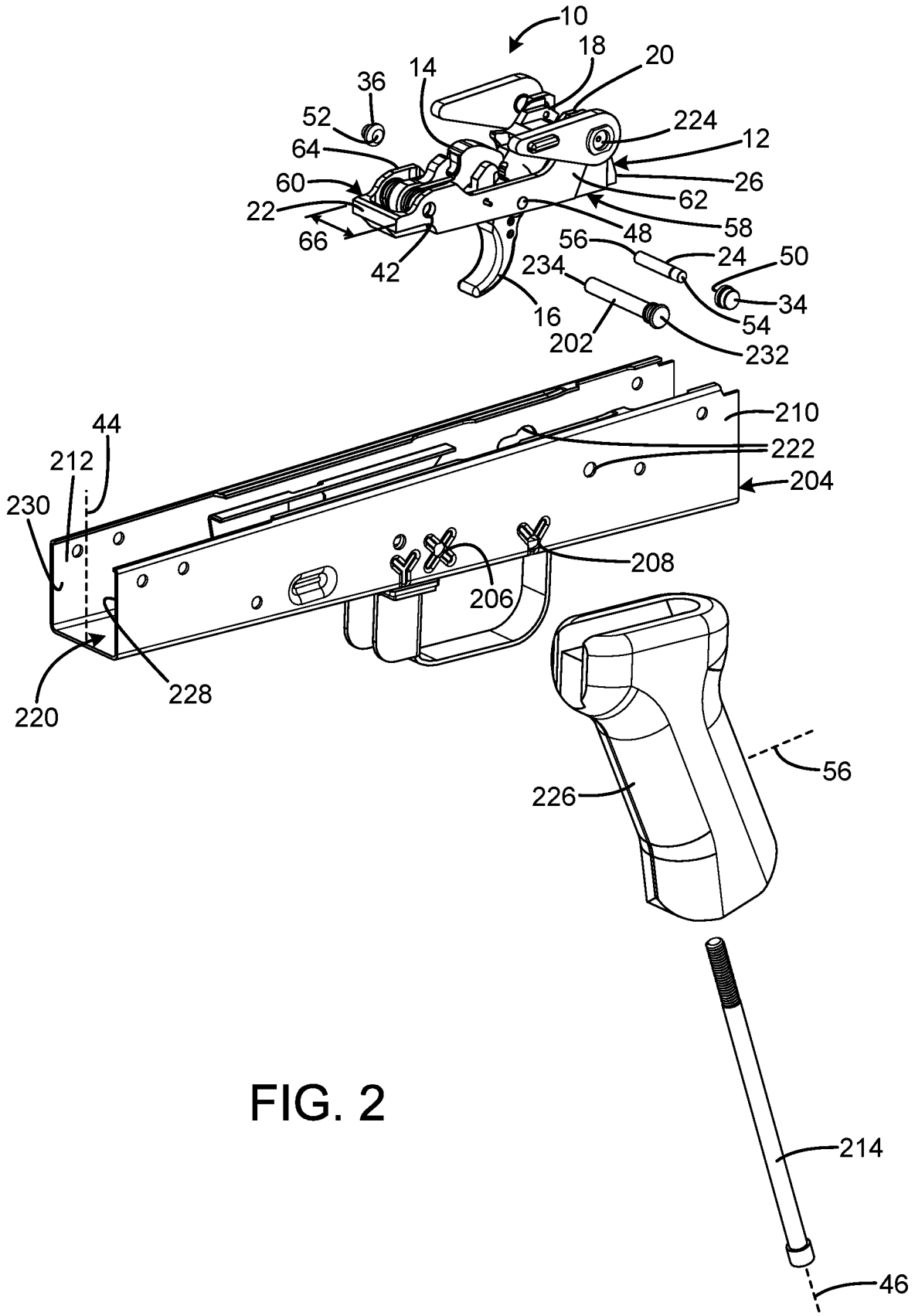
FIG. 2 is an exploded view of the current embodiment of the fire control group constructed in accordance with the principles of the present invention.
Figure 3:
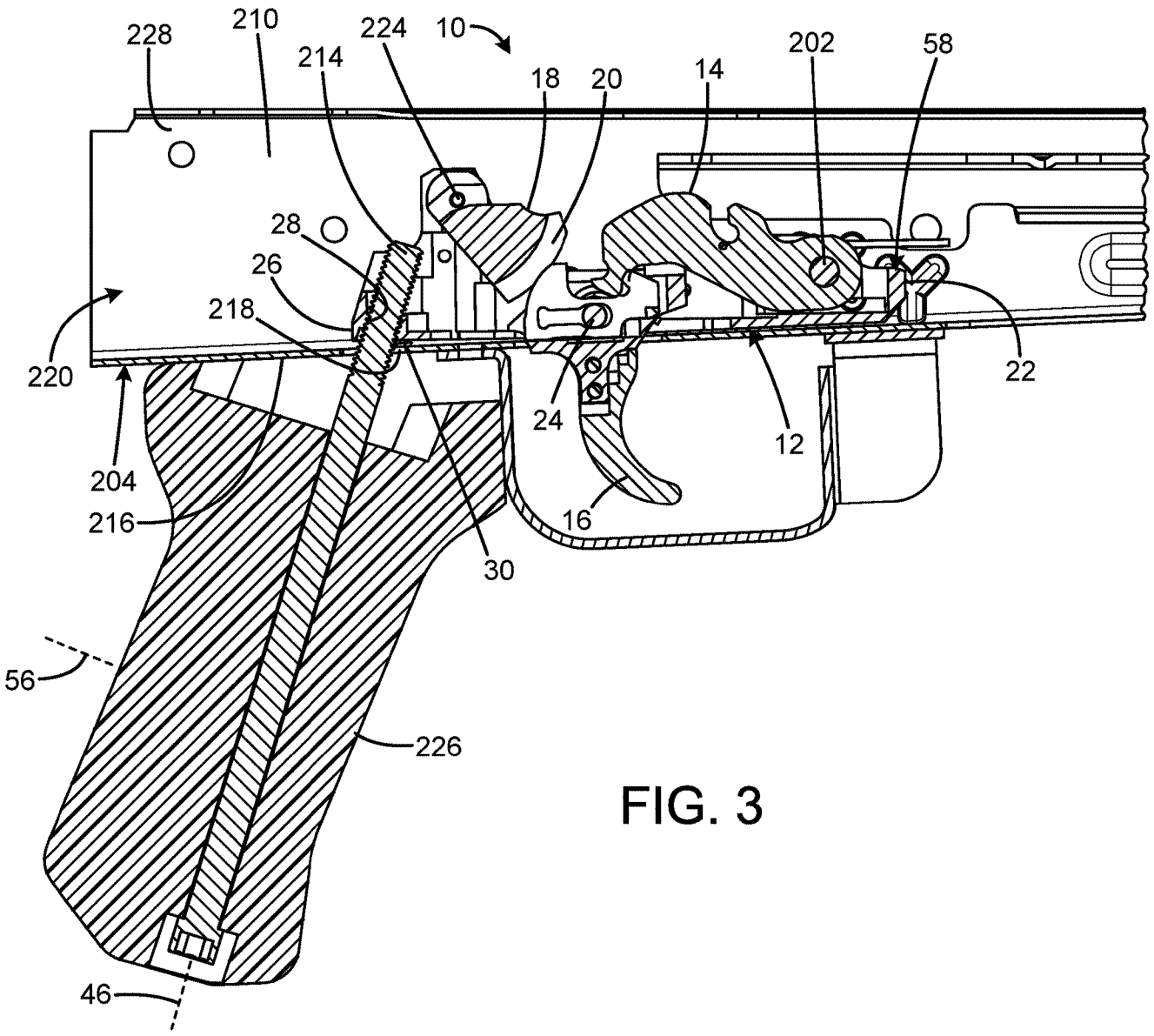
FIG. 3 is a side sectional view of the current embodiment of the fire control group of FIG. 2.
Figure 4:
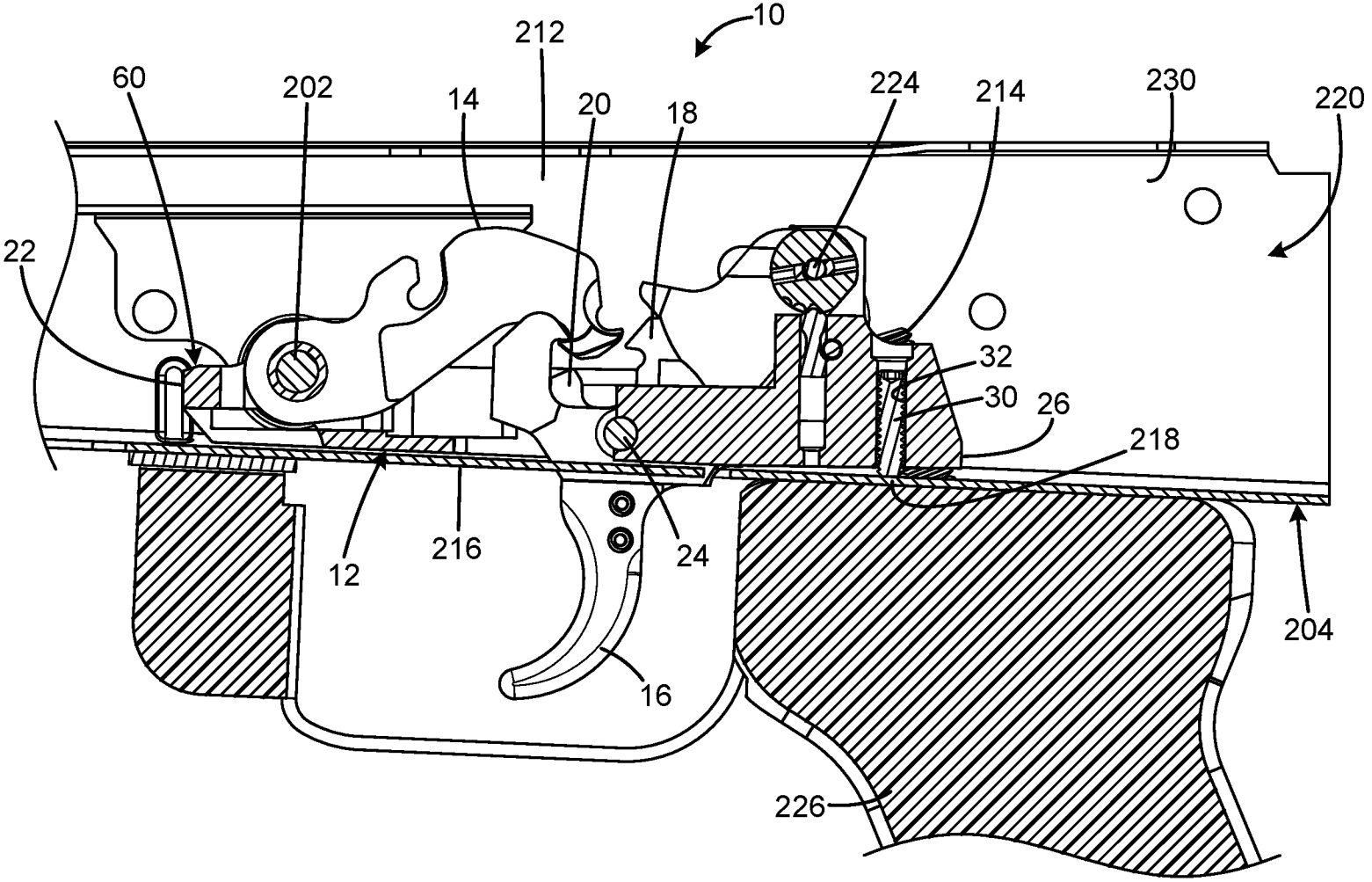
FIG. 4 is a side sectional view of the current embodiment of the fire control group of FIG. 2 taken through the set screw.
Figure 5:
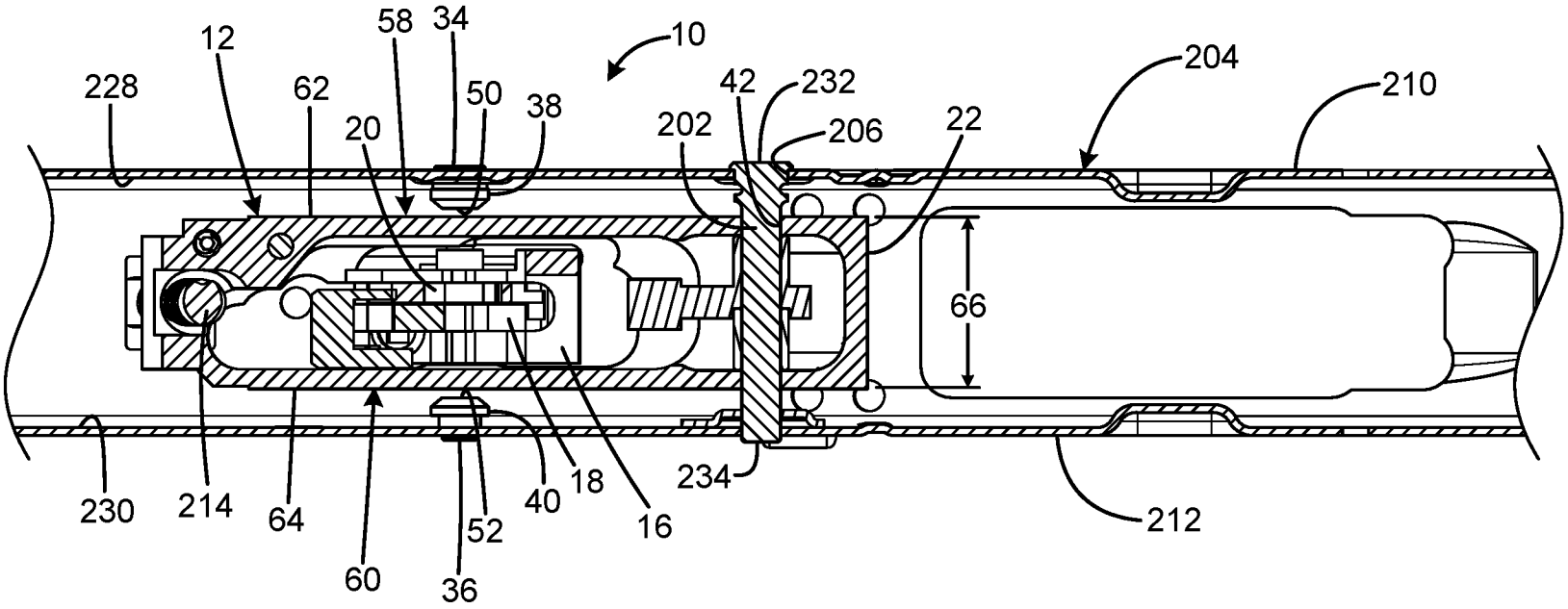
FIG. 5 is a top sectional view of the current embodiment of the fire control group of FIG. 2 taken through the hammer pin.
Figure 6:
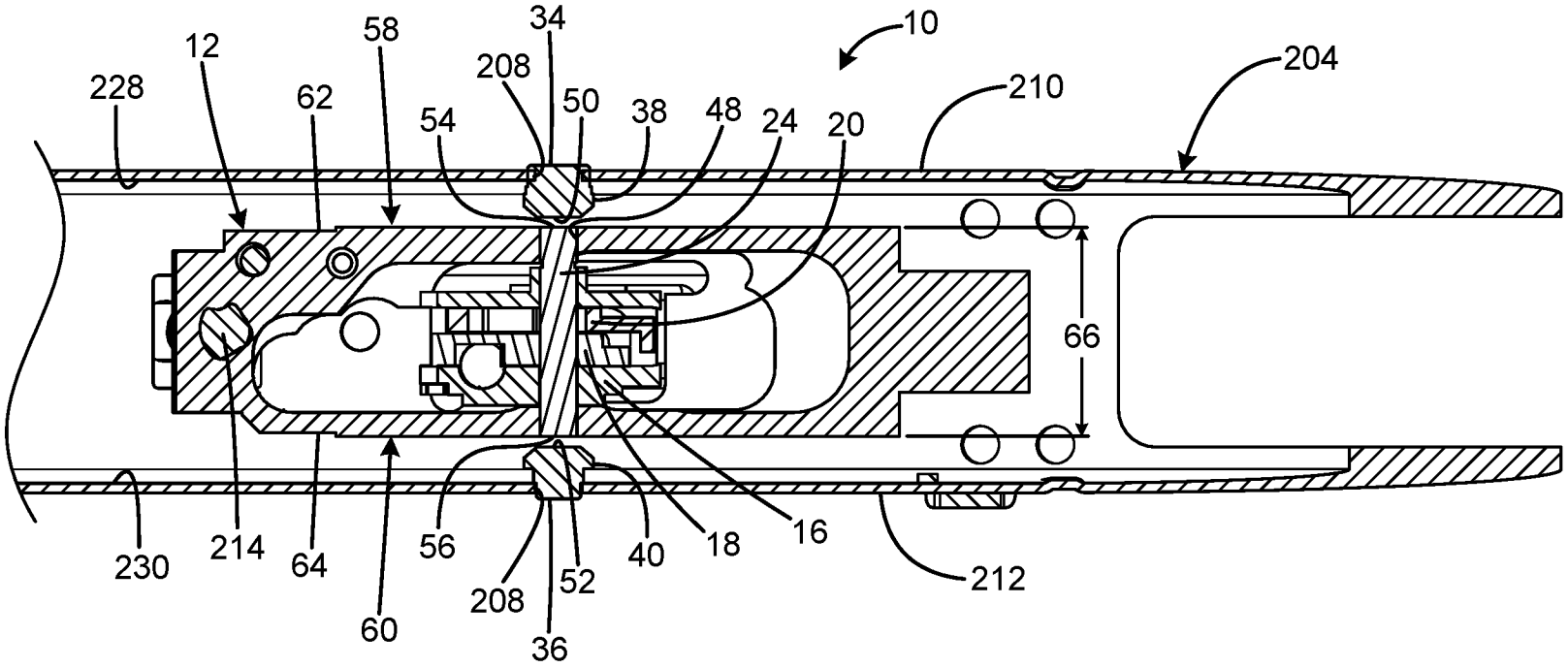
FIG. 6 is a top sectional view of the current embodiment of the fire control group of FIG. 2 taken through the trigger pin.
Figure 7:
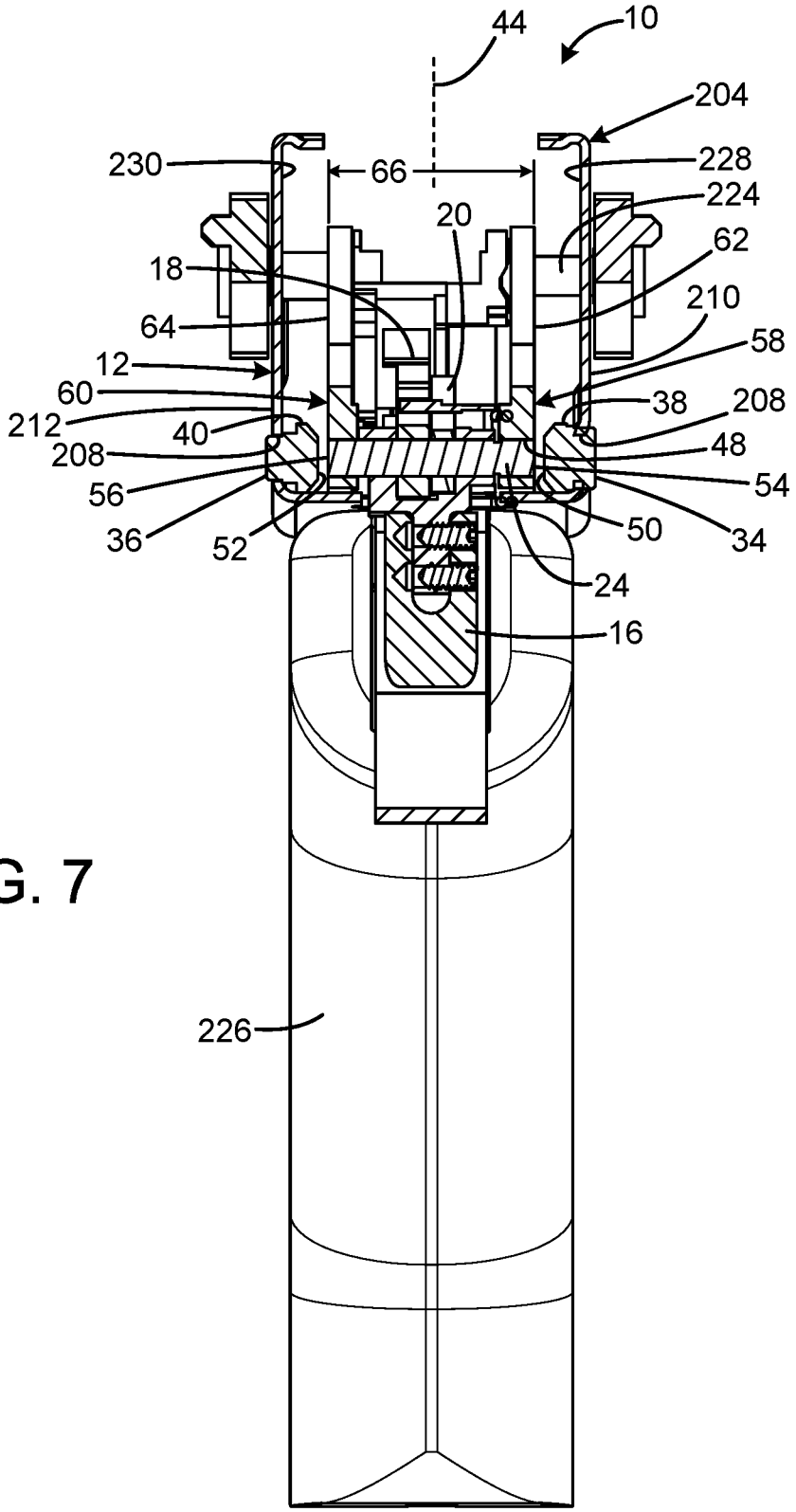
FIG. 7 is a front sectional view of the current embodiment of the fire control group of FIG. 2 taken through the trigger pin The same reference numerals refer to the same parts throughout the various figures.

An embodiment of the fire control group of the present invention is shown and generally designated by the reference numeral 10.

FIG. 1 illustrates an AK-47 rifle 200 with the improved fire control group 10 of the present invention installed therein.

FIGS. 2-7 illustrates the improved fire control group 10 of the present invention. More particularly, the fire control group has a fire control cartridge 12 that maintains tight tolerances between the hammer 14, trigger 16, disconnector 18, and intermittent disconnector spacer 20. The fire control cartridge uses the existing hammer pin 202 in the firearm receiver 204 as the forward anchor point for the front 22 of the fire control cartridge. Because the spacing between the hammer pin holes 206 and the trigger pin holes 208 in the left and right sidewalls 210, 212 of the firearm receiver can be highly variable between AK-47 variants, the trigger pin 24 deliberately does not extend laterally beyond the fire control cartridge to engage the trigger pin holes. The sole purpose of the trigger pin is to secure the trigger to the fire control cartridge. The rear 26 of the fire control cartridge is held in place by the grip screw 214, which engages threaded aperture 28 defined by the rear of the fire control cartridge.

There are multiple advantages to not using the trigger pin 24 to secure the fire control cartridge 12 to the firearm receiver 204. First, the trigger pin can be precisely positioned relative to the hammer pin 202 because the position of the trigger pin is not constrained by the location of the trigger pin holes 208 in the firearm receiver relative to the hammer pin holes 206. The fire control group 10 will still function safely even if the trigger pin holes were inaccurately positioned relative to the hammer pin holes by the firearm receiver's manufacturer. Furthermore, even if the hammer pin holes in the receiver, which serve as the forward anchor point of the fire control cartridge, are slightly mislocated, the decoupling of the trigger pin position from the trigger pin holes is more likely to compensate for the error in the manufacturing of the receiver. This is a critical consideration that enables the fire control group 10 to function properly in a variety of AK-47 variants having widely different tolerances.

A second advantage to not using the trigger pin 24 to secure the fire control cartridge 12 to the firearm receiver 204 is that the elevation of the rear 26 of the fire control cartridge can be precisely controlled and firmly established in a selected position. This is accomplished by an adjustable set screw 30 that received in threaded aperture 32, traverses vertically through the fire control cartridge, and pushes down on the floor 216 of the firearm receiver. The set screw works against the grip screw 214 to compress a portion 218 of the floor of the firearm receiver between them to firmly set the rear of the fire control cartridge in place. Additionally, the set screw and grip screw can be adjusted to enable the fire control cartridge to ride higher or lower within a channel 220 defined by the left and right sidewalls 210, 212 of the firearm receiver depending on the needs of the specific installation. This height adjustment capability is important because the bolt carrier (not shown) height relative to the fire control cartridge can create malfunctions of the AK-47 rifle 200 if the fire control cartridge is not positioned correctly. Furthermore, the set screw and the grip screw can be adjusted to compensate for inconsistent positioning of the safety selector holes 222 in the firearm receiver by various AK-47 manufacturers. In order to function safely, the safety selector shaft 224 must protrude through the left and right sides of the firearm receiver with plenty of tolerance around the safety selector shaft. The set screw and the grip screw can be adjusted to change the height of the safety selector shaft to compensate for possible deficiencies in the location of the safety selector holes in the firearm receiver.

A third advantage to not using the trigger pin 24 to secure the fire control cartridge 12 to the firearm receiver 204 is that the grip screw 214 forcibly centers the fire control cartridge within the channel 220 of the firearm receiver. This centering action eliminates the need for other potentially costly or difficult to install spacers that would otherwise be necessary to locate the fire control group 10 within the non-uniform channel of the firearm receiver.

In the current embodiment, the hammer pin 202 has a length of 1.420 inch to engage the hammer pin holes 206. The hammer pin is preferably the Original Equipment Manufacturer (OEM) hammer pin included with the AK-47. The trigger pin 24 has a length of 0.875 inch to ensure the trigger pin does not engage the trigger pin holes 208. Instead, the trigger pin holes 208 are plugged by left and right plugs 34, 36 having flanged heads 38, 40 located within the channel 220 of the firearm receiver to prevent the trigger pin from laterally walking out of the fire control cartridge 12. The left and right plugs also include inner faces 50, 52 spaced apart from inner surfaces 228, 230 of the left and right sidewalls 210, 212 to establish a lateral positional limit for the fire control group 10. The grip screw 214 can be used to secure the conventional hand grip 226 shown, or can be shortened for use with an alternative style of hand grip that has its bottom portion hollowed out.

In the current embodiment, the left and right sidewalls 210, 212 of the firearm 204 are opposed sidewalls defining a space (channel 220) configured to receive the fire control group 10. The hammer pin holes 206 defined by the opposed sidewalls are pivot pin apertures that are registered with each other. The fire control group includes a trigger 16 received in the space. The fire control group defines a transverse pivot pin passage 42 configured to be registered with the pivot pin apertures of the firearm receiver. The fire control group includes a pivoting operational element (hammer 14). The fire control group includes a pivot pin (hammer pin 202) supporting the pivoting operational element and received in the transverse pivot pin passage and the pivot pin apertures. The firearm has a hand grip 226 aft of the trigger and defining a screw aperture (threaded aperture 28). The grip screw 214 engages the hand grip and engages the fire control group.

In the current embodiment, the grip screw 214 occupies a medial plane 44 of the firearm. The grip screw 214 defines a screw axis 46 perpendicular to the pivot pin (hammer pin 202). In the current embodiment, the screw axis extends downward and rearward at an angle of 18° relative to vertical. However, it should be appreciated that AK-47s do not have a firmly established standard grip angle. The grip angle varies from rifle to rifle and can exceed ±5° relative to 18° relative to vertical. Because the grip screw angle is relative to the housing that defines "vertical," and the height of the housing depends upon the housing's rotation about the hammer pin axis, the grip screw angle is variable relative to vertical based on the installation. The variation can be up to +1.5° clockwise (when viewed from the ejection port-side of the rifle) and up to −1° counterclockwise in a US-specification AK-47 receiver that is within tolerance. Because many AK-47 specifications can be in or out of tolerance, up to a 2.5° variational installation range can exist when measured across multiple AK-47 rifle samples. The fire control group 10 defines a threaded aperture 28 receiving the grip screw. The firearm control group includes an adjustable downwardly extending set screw 30 configured to establish an elevation of at least a portion of the fire control group. The set screw is adjacent to the grip screw. The set screw is spaced apart from the pivot pin. The fire control group defines a trigger pivot passage 48 receiving a trigger pin 24 and the trigger 16 is supported by the trigger pin, and therein the trigger pin has a limited length that does not engage the firearm receiver 204. The firearm receiver defines a trigger pin aperture/hole 208 that is independently located with respect to the trigger pin. The trigger pin ends 54, 56 are flush with the fire control group. The trigger pin is received between the opposed sidewalls of the firearm receiver. The pivot pin (hammer pin 202) supporting the pivoting operational element (hammer 14) is longer than the trigger pin. The hand grip defines a primary grip axis 56, and the grip screw is perpendicular to the primary grip axis. A portion 218 of the firearm receiver is compressively received between the hand grip and the fire control group.

The fire control group 10 can be viewed as a trigger module. The fire control cartridge 12 is a module housing having module sidewalls 58, 60 with opposed parallel external wall surfaces 62, 64 defining a module width 66. The hammer pin 202 extends transversely through the module sidewalls and has a length greater than the module width such that the hammer pin ends 232, 234 are configured to be received in opposed pin apertures (hammer pin holes 206) of the firearm receiver. The module housing defines a threaded aperture 28 at a rear portion 26 of the module housing. The threaded aperture is oriented to receive the grip screw 214 received by and engaging hand grip 226 to secure the rear portion of the module housing.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a fire control group has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a receiver having opposed sidewalls defining a space configured to receive a fire control group;

the opposed sidewalls each defining a pivot pin aperture; the pivot pin apertures being registered with each other;

a fire control group including a trigger received in the space;

the fire control group defining a transverse pivot pin passage configured to be registered with the pivot pin apertures of the receiver;

the fire control group including a pivoting operational element;

the fire control group including a pivot pin supporting the pivoting operational element and received in the pivot pin passage and the pivot pin apertures;

the firearm having a hand grip aft of the trigger and defining a screw aperture;

a grip screw engaging the hand grip and engaging the fire control group; and wherein the fire control group defines a threaded aperture receiving the grip screw.

2. The firearm of claim 1 wherein the grip screw occupies a medial plane of the firearm.

3. The firearm of claim 1 wherein the grip screw defines a screw axis perpendicular to the pivot pin.

4. The firearm of claim 1 wherein the firearm control group includes an adjustable downwardly extending set screw configured to establish a pitch orientation of the fire control group.

5. The firearm of claim 1 wherein the firearm control group includes an adjustable downwardly extending set screw configured to establish an elevation of at least a portion of the fire control group.

6. The firearm of claim 5 wherein the set screw is adjacent to the grip screw.

7. The firearm of claim 5 wherein the set screw is spaced apart from the pivot pin.

8. The firearm of claim 1 wherein the pivoting operational element supported by the pivot pin is a hammer.

9. The firearm of claim 1 wherein the fire control group defines a trigger pivot passage receiving a trigger pivot pin and the trigger is supported by the trigger pin, and therein the trigger pin has a limited length that does not engage the receiver.

10. The firearm of claim 9 wherein the receiver defines a trigger pin aperture that is independently located with respect to the trigger pin.

11. The firearm of claim 9 including a plug received in the trigger pin aperture.

12. The firearm of claim 11 wherein the plug has an inner face spaced apart from an inner surface of the receiver sidewall to establish a lateral positional limit for the fire control group.

13. The firearm of claim 9 wherein the trigger pin ends are flush with the fire control group.

14. The firearm of claim 9 wherein the trigger pin is received between the opposed sidewalls of the receiver.

15. The firearm of claim 9 wherein the pivot pin supporting the pivoting operational element is longer than the trigger pin.

16. The firearm of claim 1 including only a single transverse pin engaging both the receiver and the fire control group.

17. The firearm of claim 1 wherein the hand grip defines a primary grip axis and the grip screw is perpendicular to the primary grip axis.

18. The firearm of claim 1 wherein a portion of the receiver is compressively received between the hand grip and the fire control group.

19. A trigger module for a firearm having a receiver with opposed receiver sidewalls defining a plurality of pin apertures, the module comprising:

a module housing having module sidewalls with opposed parallel external wall surfaces defining a module width;

a hammer pin extending transversely though the module sidewalls and having a length greater than the module width such that the hammer pin ends are configured to be received in opposed pin apertures of the receiver;

the module housing defining a threaded aperture at a rear portion of the module housing;

the threaded aperture being oriented to receive a grip screw received by and engaging a grip to secure the rear portion of the module housing.

20. A firearm comprising:

a receiver having opposed sidewalls defining a space configured to removably receive a fire control group;

the opposed sidewalls each defining a pivot pin aperture; the pivot pin apertures being registered with each other;

a fire control group including a trigger received in the space;

the fire control group defining a transverse pivot pin passage configured to be registered with the pivot pin apertures of the receiver;

the fire control group including a pivoting operational element;

the fire control group including a pivot pin supporting the pivoting operational element and received in the pivot pin passage and the pivot pin apertures;

the firearm having a hand grip aft of the trigger and defining a screw aperture;

a grip screw engaging the hand grip and engaging the fire control group;

wherein the receiver has a wall portion received between the hand grip and the fire control group; and wherein the wall portion is compressibly received between the hand grip and the fire control group.

21. The firearm of claim 20 wherein the receiver defines an aperture receiving a fastener interconnecting the grip and the fire control group.

22. The firearm of claim 21 wherein the fastener includes a threaded portion.

23. The firearm of claim 20 wherein the grip screw occupies a medial plane of the firearm.

24. The firearm of claim 20 wherein the grip screw defines a screw axis perpendicular to the pivot pin.

25. The firearm of claim 20 wherein the fire control group defines a threaded aperture receiving the grip screw.

26. The firearm of claim 20 wherein the firearm control group includes an adjustable downwardly extending set screw configured to establish a pitch orientation of the fire control group.

27. The firearm of claim 20 wherein the firearm control group includes an adjustable downwardly extending set screw configured to establish an elevation of at least a portion of the fire control group.

28. The firearm of claim 27 wherein the set screw is adjacent to the grip screw.

29. The firearm of claim 27 wherein the set screw is spaced apart from the pivot pin.

30. The firearm of claim 20 wherein the pivoting operational element supported by the pivot pin is a hammer.

31. The firearm of claim 20 wherein the fire control group defines a trigger pivot passage receiving a trigger pivot pin and the trigger is supported by the trigger pin, and therein the trigger pin has a limited length that does not engage the receiver.

32. The firearm of claim 31 wherein the receiver defines a trigger pin aperture that is independently located with respect to the trigger pin.

33. The firearm of claim 31 including a plug received in the trigger pin aperture.

34. The firearm of claim 33 wherein the plug has an inner face spaced apart from an inner surface of the receiver sidewall to establish a lateral positional limit for the fire control group.

35. The firearm of claim 31 wherein the trigger pin ends are flush with the fire control group.

36. The firearm of claim 31 wherein the trigger pin is received between the opposed sidewalls of the receiver.

37. The firearm of claim 31 wherein the pivot pin supporting the pivoting operational element is longer than the trigger pin.

38. The firearm of claim 20 including only a single transverse pin engaging both the receiver and the fire control group.

39. The firearm of claim 20 wherein the hand grip defines a primary grip axis and the grip screw is perpendicular to the primary grip axis.

40. The firearm of claim 20 wherein a portion of the receiver is compressively received between the hand grip and the fire control group.

* * * * *